US011164432B2

(12) United States Patent
Carballido Villaverde et al.

(10) Patent No.: US 11,164,432 B2
(45) Date of Patent: Nov. 2, 2021

(54) SYSTEM AND METHOD FOR FIRE SENSING AND CONTROLLING ESCAPE PATH GUIDE SIGNS ACCORDINGLY

(71) Applicant: Carrier Corporation, Palm Beach Gardens, FL (US)

(72) Inventors: Berta Carballido Villaverde, Leon (ES); Rodolfo De Paz Alberola, Alicante (ES)

(73) Assignee: CARRIER CORPORATION, Palm Beach Gardens, FL (US)

( * ) Notice: Subject to any disclaimer, the term of this patent is extended or adjusted under 35 U.S.C. 154(b) by 102 days.

(21) Appl. No.: 16/493,545

(22) PCT Filed: Mar. 15, 2018

(86) PCT No.: PCT/US2018/022577
§ 371 (c)(1),
(2) Date: Sep. 12, 2019

(87) PCT Pub. No.: WO2018/170226
PCT Pub. Date: Sep. 20, 2018

(65) Prior Publication Data

US 2021/0142630 A1 May 13, 2021

Related U.S. Application Data

(60) Provisional application No. 62/471,642, filed on Mar. 15, 2017.

(51) Int. Cl.
*G08B 7/06* (2006.01)
*G08B 17/00* (2006.01)

(52) U.S. Cl.
CPC ..... *G08B 7/066* (2013.01); *G08B 17/00* (2013.01)

(58) Field of Classification Search
CPC ..... G08B 7/066; G08B 17/00
(Continued)

(56) References Cited

U.S. PATENT DOCUMENTS 5,979,607 A 11/1999 Allen
7,026,947 B2 4/2006 Faltesek
(Continued)

FOREIGN PATENT DOCUMENTS

DE 10154146 A1 6/2003
WO 2009038557 A1 3/2009
WO 2013005122 A1 1/2013

OTHER PUBLICATIONS

Notification of Transmittal of the International Search Report for International Application No. PCT/US2018/022577 Report dated Aug. 8, 2018; 8 pages.
(Continued)

*Primary Examiner* — John A Tweel, Jr.
(74) *Attorney, Agent, or Firm* — Cantor Colburn LLP

(57) ABSTRACT

A system for directing an emergency evacuation within a building composed of a plurality of rooms separated by entryways is provided. The system comprising: a plurality of fire detectors configured to detect a fire in each room; and a plurality of signs configured to display evacuation information, each of the signs being in communication each of the fire detectors and configured to determine an evacuation route to an exit located nearest to each sign.

15 Claims, 10 Drawing Sheets

(58) Field of Classification Search
USPC ..... 340/501
See application file for complete search history.

(56) References Cited

U.S. PATENT DOCUMENTS

| | | | | |
|---|---|---|---|---|
| 7,626,507 | B2 | 12/2009 | Lacasse | |
| 7,683,793 | B2 | 3/2010 | Li et al. | |
| 8,466,785 | B2 | 6/2013 | Kamalakannan et al. | |
| 8,935,095 | B2 | 1/2015 | Hartman et al. | |
| 8,970,365 | B2 * | 3/2015 | Wedig | G08B 7/066 340/539.11 |
| 9,189,939 | B2 | 11/2015 | Wedig et al. | |
| 9,644,974 | B2 * | 5/2017 | Plocher | G09F 9/33 |
| 10,769,902 | B1 * | 9/2020 | Kronz | H04W 4/38 |
| 2002/0057204 | A1 | 5/2002 | Bligh | |
| 2011/0267179 | A1 | 11/2011 | Patterson | |
| 2012/0047083 | A1 | 2/2012 | Qiao et al. | |
| 2012/0276517 | A1 | 11/2012 | Banaszuk et al. | |
| 2014/0139539 | A1 * | 5/2014 | Byers | G09G 5/10 345/589 |
| 2014/0167969 | A1 | 6/2014 | Wedig et al. | |
| 2016/0042615 | A1 | 2/2016 | Turner et al. | |
| 2016/0247369 | A1 | 8/2016 | Simmons | |
| 2018/0050226 | A1 * | 2/2018 | Park | A62B 3/00 |
| 2019/0057594 | A1 * | 2/2019 | Lelievre | G08B 5/221 |
| 2019/0295386 | A1 * | 9/2019 | Roberts | H02J 9/065 |

OTHER PUBLICATIONS

Written Opinion of the International Searching Authority for International Application No. PCT/US2018/022577; dated Aug. 8, 2018; 10 pages.

Yuanyuan Zeng, et al.; Building Fire Emergency Detection and Response Using Wireless Sensor Networks; Building Fire Emergency Detection and Response Using Wireless Sensor Networks; Dec. 9, 2009; 8 pges.

* cited by examiner

SYSTEM AND METHOD FOR FIRE SENSING AND CONTROLLING ESCAPE PATH GUIDE SIGNS ACCORDINGLY

CROSS-REFERENCE TO RELATED APPLICATIONS

This application is a National Stage of International Application No. PCT/US2018/022577 filed Mar. 15, 2018, which claims priority to U.S. Provisional Patent Application Ser. No. 62/471,642 filed Mar. 15, 2017, both of which are incorporated herein by reference in their entirety.

BACKGROUND

The embodiments herein generally relate to fire detections systems and more specifically, the fire detection systems within buildings.

Typically, building fire alarm systems and smoke detectors inform a local controller to trigger an alarm as well as suppression (i.e. water sprinklers) and egress systems (visual and audible signals) in order to stop fire from spreading and aid building occupants evacuation. Some building systems also report the event of fire to a remote central station. This central station can interrogate one or more building systems and combine the received information to provide a more detailed report when contacting emergency services. Given this architecture, if the network gateway or the paths that lead to the gateway become inaccessible, due to fire damage, then the whole system becomes no longer useful. A system that is able to work in both distributed and centralized modes offers an advantage in terms of reliability, as the lifetime of the system can be extended once the panel is not reachable.

BRIEF DESCRIPTION

According to one embodiment, a system for directing an emergency evacuation within a building composed of a plurality of rooms separated by entryways is provided. The system comprising: a plurality of fire detectors configured to detect a fire in each room; and a plurality of signs configured to display evacuation information, each of the signs being in communication with each of the fire detectors and configured to determine an evacuation route to an exit located nearest to each sign.

In addition to one or more of the features described above, or as an alternative, further embodiments of the system may include where the evacuation route does not pass through a room where a fire has been detected.

In addition to one or more of the features described above, or as an alternative, further embodiments of the system may include where the evacuation information includes a number of rooms between the sign displaying the evacuation information and the exit located nearest to the sign displaying the evacuation information.

In addition to one or more of the features described above, or as an alternative, further embodiments of the system may include where each room includes a sign at each entryway.

In addition to one or more of the features described above, or as an alternative, further embodiments of the system may include a plurality of human presence detectors configured to detect a human being in each room, each human presence detector being in communication with each sign.

In addition to one or more of the features described above, or as an alternative, further embodiments of the system may include where the evacuation information includes a human being symbol when a being is detected in a room along the evacuation route.

In addition to one or more of the features described above, or as an alternative, further embodiments of the system may include where the evacuation information includes a fire symbol when a fire is detected along the evacuation route.

In addition to one or more of the features described above, or as an alternative, further embodiments of the system may include where the evacuation information includes a warning if a route is not the shortest evacuation route.

In addition to one or more of the features described above, or as an alternative, further embodiments of the system may include where the plurality of rooms comprises a first room and a second room connected to the first room by at least one entryway, the second room having no exit other than an entryway towards the first room; and the plurality of signs comprises a first sign in the first room located at an entryway towards the second room, the first sign displaying evacuation information including a do not enter warning.

In addition to one or more of the features described above, or as an alternative, further embodiments of the system may include where the plurality of rooms comprises a first room and a second room connected to the first room by at least one entryway, a fire being detected in the second room; and the plurality of signs comprises a first sign in the first room located at an entryway towards the second room, the first sign displaying evacuation information including a fire symbol.

In addition to one or more of the features described above, or as an alternative, further embodiments of the system may include where the plurality of rooms comprises a first room and a second room connected to the first room by at least one entryway, a fire being detected in the second room; and the plurality of signs comprises a first sign in the first room located at an entryway towards the second room, the first sign displaying evacuation information including a fire symbol when there is no exit located between the first room and the second room.

In addition to one or more of the features described above, or as an alternative, further embodiments of the system may include where the plurality of rooms comprises a first room and a second room connected to the first room by at least one entryway, a fire being detected in the second room and a human being detected in a room between the first room and the second room; and the plurality of signs comprises a first sign in the first room located at an entryway towards the second room, the first sign displaying evacuation information including a human symbol when there is no exit located between the first room and the second room.

In addition to one or more of the features described above, or as an alternative, further embodiments of the system may include where the plurality of rooms comprises a first room and a second room connected to the first room by at least one entryway, a fire being detected in the second room and a human being detected in the second room; and the plurality of signs comprises a first sign in the first room located at an entryway towards the second room, the first sign displaying evacuation information including a human symbol when there is no exit located between the first room and the second room.

In addition to one or more of the features described above, or as an alternative, further embodiments of the system may include where the plurality of rooms comprises a first room, a second room connected to the first room by first entryway, and a third room connected to the first room by a second entryway, a fire being detected in the second room; and the plurality of signs comprises: a first sign in the first room located at the first entryway, the first sign displaying evacuation information including a fire symbol; and a second sign in the first room at the second entryway, the second sign displaying evacuation information including a number of rooms between the second sign and an exit located nearest the second sign.

In addition to one or more of the features described above, or as an alternative, further embodiments of the system may include where the plurality of rooms comprises a first room, a second room connected to the first room by first entryway, and a third room connected to the first room by a second entryway, the third room being closer to an exit than the second room; and the plurality of signs comprises: a first sign in the first room located at the first entryway, the first sign displaying evacuation information including a do not enter symbol; and a second sign in the first room at the second entryway, the second sign displaying evacuation information including a number of rooms between the second sign and an exit located nearest the second sign.

According to another embodiment, a method of directing an emergency evacuation within a building composed of a plurality of rooms separated by entryways. The method comprising: detecting a fire in at least one of the plurality of rooms using a plurality of fire detectors; determining an evacuation route to an exit located nearest to each sign, the evacuation route including rooms where a fire has not been detected; and displaying evacuation information using a plurality of signs, each of the signs being in communication with each of the fire detectors; wherein the evacuation information includes a number of rooms along the evacuation route between the sign displaying the evacuation information and the exit located nearest to the sign displaying the evacuation information.

According to another embodiment, a computer program product tangibly embodied on a computer readable medium is provided. The computer program product including instructions that, when executed by a processor, cause the processor to perform operations comprising: detecting a fire in at least one of a plurality of rooms using a plurality of fire detectors; determining an evacuation route to an exit located nearest to each sign, the evacuation route including rooms where a fire has not been detected; and displaying evacuation information using a plurality of signs, each of the signs being in communication with each of the fire detectors; wherein the evacuation information includes a number of rooms along the evacuation route between the sign displaying the evacuation information and the exit located nearest to the sign displaying the evacuation information.

Technical effects of embodiments of the present disclosure include a visual egress system that can help direct evacuees to the nearest exit.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
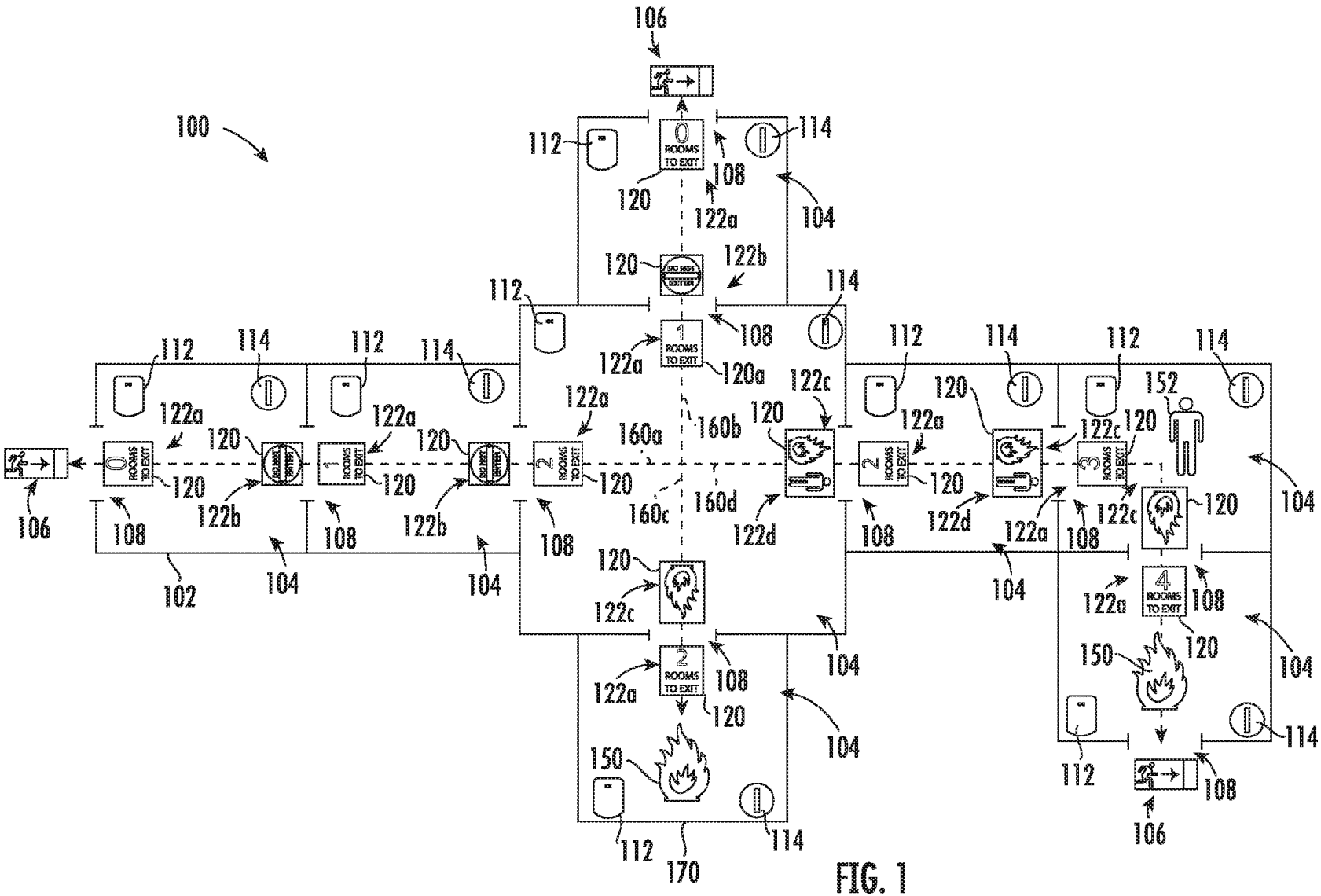
FIG. 1 is a schematic illustration of a system for directing an emergency evacuation within a building composed of a plurality of rooms separated by entryways, according to an embodiment of the present disclosure.
Figure 2:
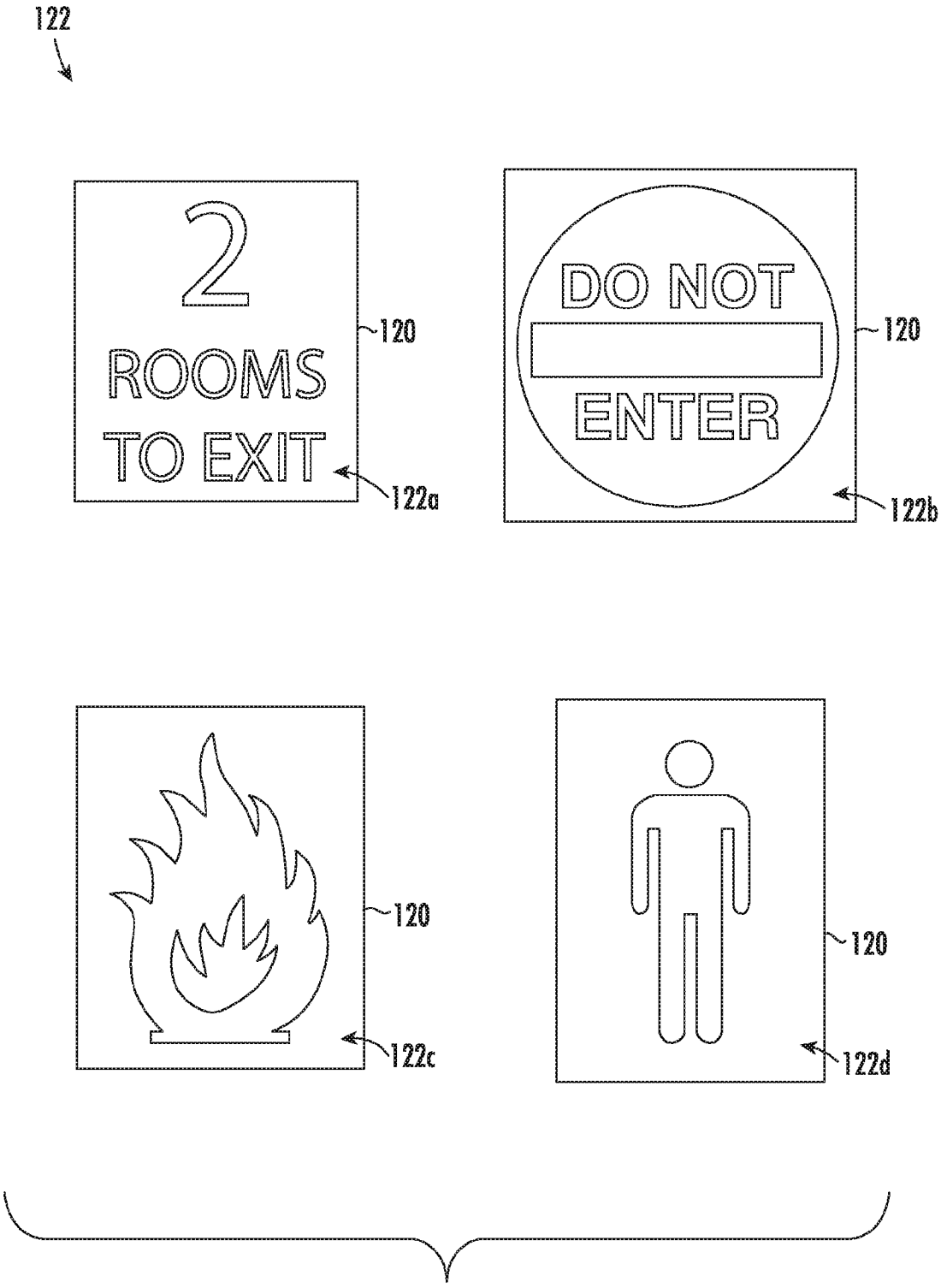
FIG. 2 is a schematic illustration of evacuation instructions to be displayed on signs during an emergency evacuation, according to an embodiment of the present disclosure.

Referring to FIGS. 1 and 2, various embodiments of the present disclosure are illustrated. FIG. 1 shows a system 100 for directing an emergency evacuation within a building 102 composed of a plurality of rooms 104 separated by entryways 108. The entryway 108 may be a door or an opening. FIG. 2 shows different evacuation information that may be displayed on signs 120 located in each room 104 of FIG. 4.

As seen in FIG. 1, the building 102 includes a plurality of fire detectors 114 configured to detect a fire 150 in each room 104. Further, the plurality of fire detectors 114 are also configured to identify the room containing the fire 150. Each room 104 may have a fire detector 114 located within the room 104. Each fire detector 114 may be in communication with each other fire detector 114. The building 102 also includes a plurality of human presence detector 112 configured to detect a human being 152 in each room 104. Further, the plurality of human presence detectors 112 are also configured to identify the room where a human being 152 was detected. Each room 104 may have a human presence detector 112 located within the room 104. Each human presence detector 112 may be in communication with each other human presence detector 112. The human presence detector 112 may use a variety of ranging sensors and/or presence detection devices to detect human beings such as, for example, a visual detection device, a laser detection device, a thermal image detection device, a depth detection device, a motion detection device, an odor detection device, RADAR, and ultrasonic sensor.

The building 102 also includes a plurality of signs 120 configured to display evacuation information 122. The plurality of signs 120 may each be in communication with each of the fire detectors 114 and the human presence detectors 112. The plurality of signs 120 may also be in communication with each other. The communication may be wired and/or wireless. Each sign 120 may be a back lit translucent sign, an edge lit sign, a computer monitor, television, or any other similar sign known to one of skill in the art. As seen in FIG. 2, the evacuation information 122 may include but is not limited to a number of rooms 122*a* to a nearest exit 106, a do not enter symbol 122*b*, a fire symbol 122*c*, and a human being symbol 122*d*. The number of rooms 122*a* to a nearest exit 106 may indicate the number of rooms 104 one may have to travel through in order to make it to the nearest exit 106 when traveling in a direction towards the sign 120 displaying the number of rooms 122*a* to a nearest exit 106 as evacuation information 122. The do not enter symbol

122*b* may indicate a route in the direction of the sign 120 displaying the do not enter symbol 122*b* does not have an exit 106 and/or that the route is not the shortest route to an exit 106. The fire symbol 122*c* may indicate that a fire 150 is located in a room 104 ahead, when traveling in a direction towards the sign 120 displaying the fire symbol 122*c* as evacuation information 122. The human being symbol 122*d* may indicate that a human being 152 is located in a room 104 ahead, when traveling in a direction towards the sign 120 displaying the human being symbol 122*d* as evacuation information 122.

The signs 120 are configured to determine an evacuation route to an exit 106 located nearest to each sign 120. The signs 120 may be linked to a central controller that determines the evacuation route or the signs 120 may be configured to make the determination independently or in conjunction with other devices such as human presence detectors 112, fire detectors 114, and/or signs 120. The central controller, detectors, and/or each sign may include a processor and an associated memory. The processor may be, but is not limited to, a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory may be but is not limited to a random access memory (RAM), read only memory (ROM), or other electronic, optical, magnetic or any other computer readable medium.

FIG. 1 shows multiple evacuation routes 160*a*-160*d* but only two routes 160*a*, 160*b* are viable evacuation routes because they do not travel through a room where fire 150 has been detected and/or a dead end 170. As seen in FIG. 1, route 160*c* leads to a dead end 170 where a fire 150 is located and the signs 120 in the direction of route 160*c* display the fire symbol 120*c* to warn evacuees. The route 160*d* leads to an exit 106 but the route 160*d* is blocked by fire 150, thus the signs 120 heading in the direction of route 160*d* display the fire symbol 122*c* to warn evacuees. Further, one or more human presence detectors 112 detect a human being 152 along route 160*d*, thus the signs 120 heading in the direction of route 160*d* display a human being symbol 122*d*. Advantageously, the human being symbol 152 may help direct fire fighters and/or other rescue personnel to help locate stranded human beings. When traveling in the opposite direction of routes 160*c*, 160*d*, the signs 120 will display the number of rooms 122*a* to a nearest exit 106 as the evacuation information 122 to help guide evacuees out and away from the fire 150.

Further, as seen in FIG. 1, routes 160*a*, 160*b* lead to exits 106, thus the signs 120 in the directions of the routes 160*a*, 160*b* each display the number of rooms 122*a* to a nearest exit 106. Advantageously, by displaying the number of rooms 122*a* to a nearest exit 106, the evacuee may pick a viable evacuation route that may help the evacuee reach an exit the fastest. In various other embodiments, other measurable quantities may also be displayed such as, for example, distance to the nearest exit 106 and/or time to the nearest exit 106. When traveling in a direction opposite of routes 160*a*, 160*b* the signs 120 display the do not enter symbol 122*b* to help instruct evacuees that they are travelling in the wrong directions and the route they are currently on is not the shortest evacuation route.

Figure 3:
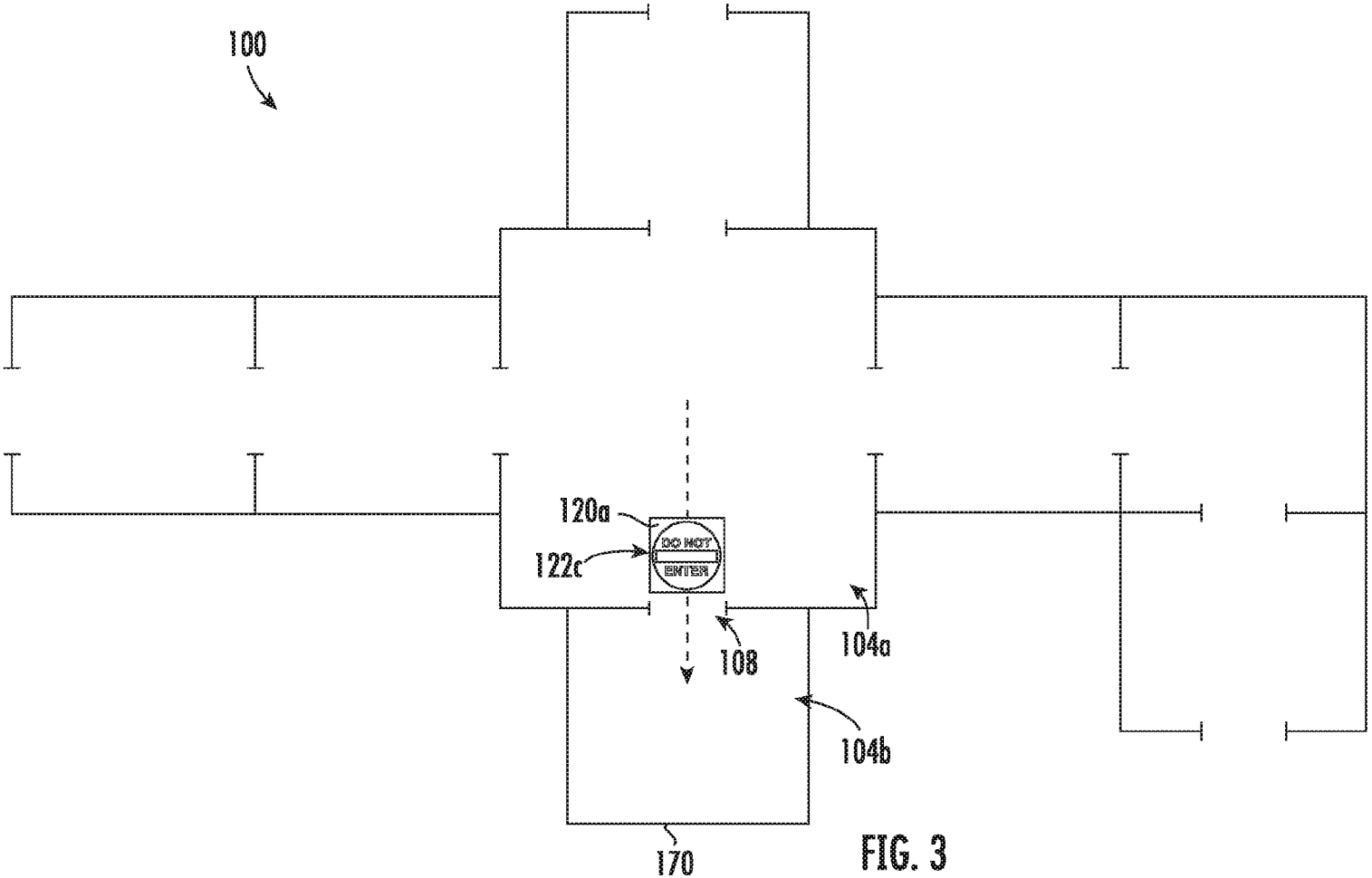
FIGS. 3-9 are examples of the operation of the system of FIG. 1, according to an embodiment of the present disclosure.

Referring now to FIG. 3, while continuing to reference FIGS. 1-2. FIG. 3 illustrates the operation of the system 100 in a first example. In the example of FIG. 3, the plurality of rooms 104 comprise a first room 104*a* and a second room 104*b* connected to the first room 104*a* by at least one entryway 108. The second room 104*b* has no exit other than an entryway 108 towards the first room 104*a* (i.e. the second room 104*b* has a dead end 170). The plurality of signs 120 comprises a first sign 120*a* in the first room 104*a* located at an entryway 108 towards the second room 104*b*. The first sign 120*a* displaying evacuation information 122 including a do not enter warning 122*c*.

Figure 4:
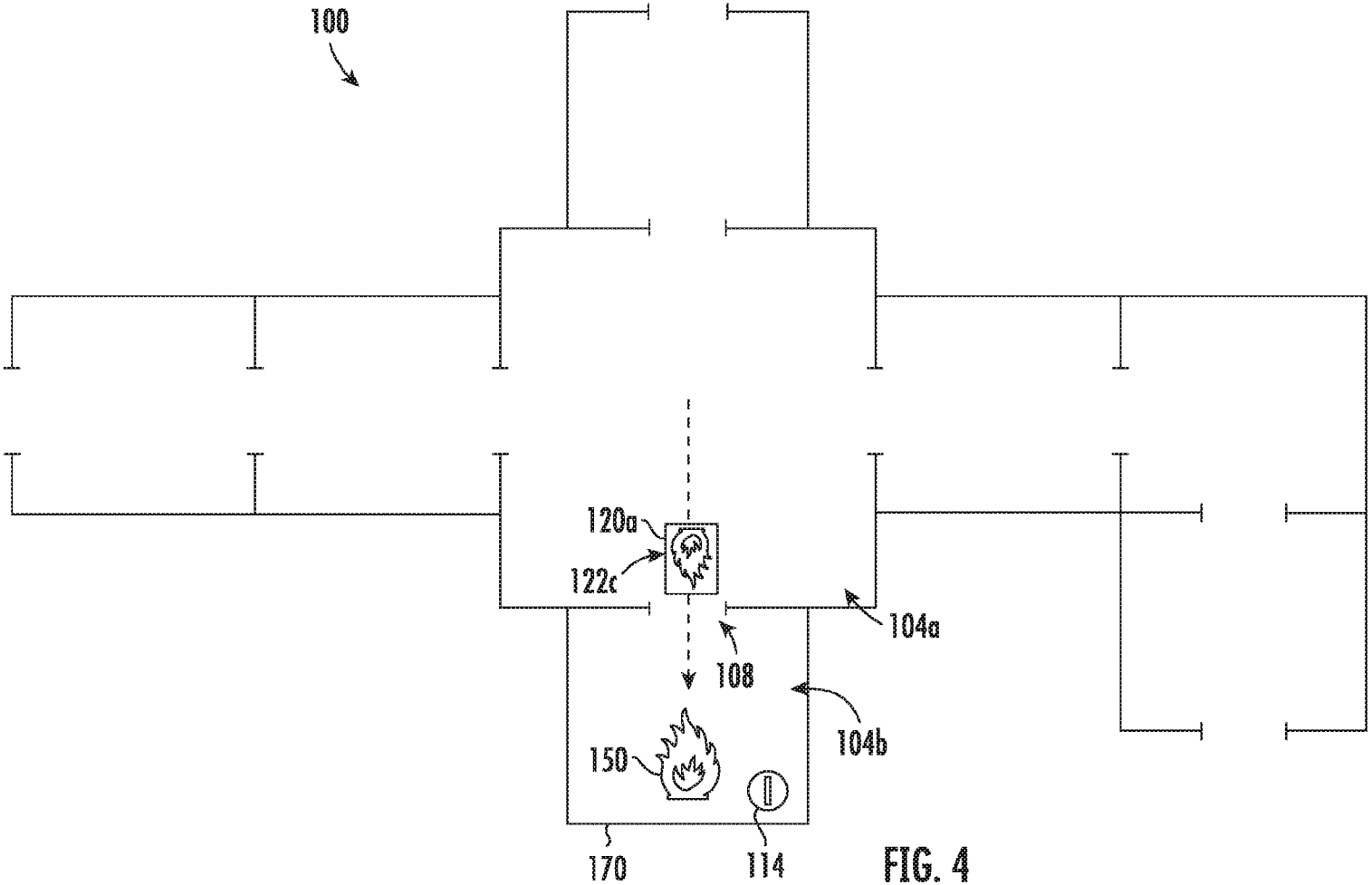

Referring now to FIG. 4, while continuing to reference FIGS. 1-2. FIG. 4 illustrates the operations of the system 100 in a second example. In the example of FIG. 4, the plurality of rooms 104 comprise a first room 104*a* and a second room 104*b* connected to the first room 104*a* by at least one entryway 108. The second room 104*b* has no exit other than an entryway 108 towards the first room 104*a* (i.e. the second room 104*b* has a dead end 170). A fire 150 is detected in the second room 104*b* by a fire detector 114. The plurality of signs 120 comprises a first sign 120*a* in the first room 104*a* located at an entryway 108 towards the second room 104*b*. The first sign 120*a* displays evacuation information 122 including a fire symbol 122*c*.

Figure 5:
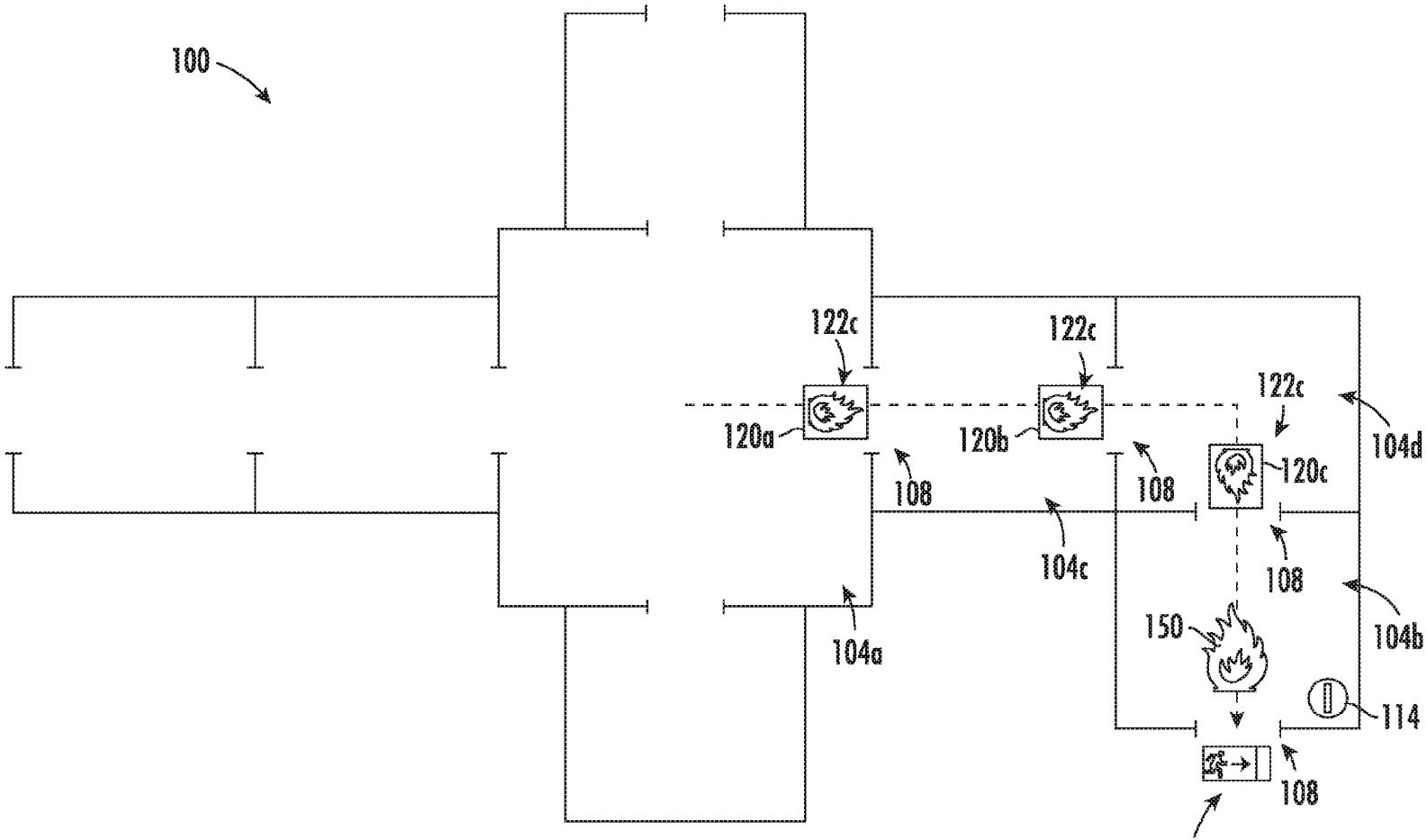

Referring now to FIG. 5, while continuing to reference FIGS. 1-2. FIG. 5 illustrates the operations of the system 100 in a third example. In the example of FIG. 5, the plurality of rooms 104 comprise a first room 104*a* and a second room 104*b* connected to the first room by at least one entryway 108. There may be rooms 104*c*, 104*d* in between the first room 104*a* and the second room 104*b*. A fire 150 is detected in the second room 104*b* by a fire detector 114. The plurality of signs 120 comprises a first sign 120*a* in the first room 104*a* located at an entryway 108 towards the second room 104*b*. The plurality of signs 120 may also include a second sign 120*b* in the third room 104*c* located at an entry way 108 towards the fourth room 104*d* and a third sign 120*c* in the fourth room 104*d* located at an entry way 108 towards the second room 104*b*. The signs 120*a*, 120*b*, 120*c* display evacuation information 122 including a fire symbol 122*c*.

Figure 6:
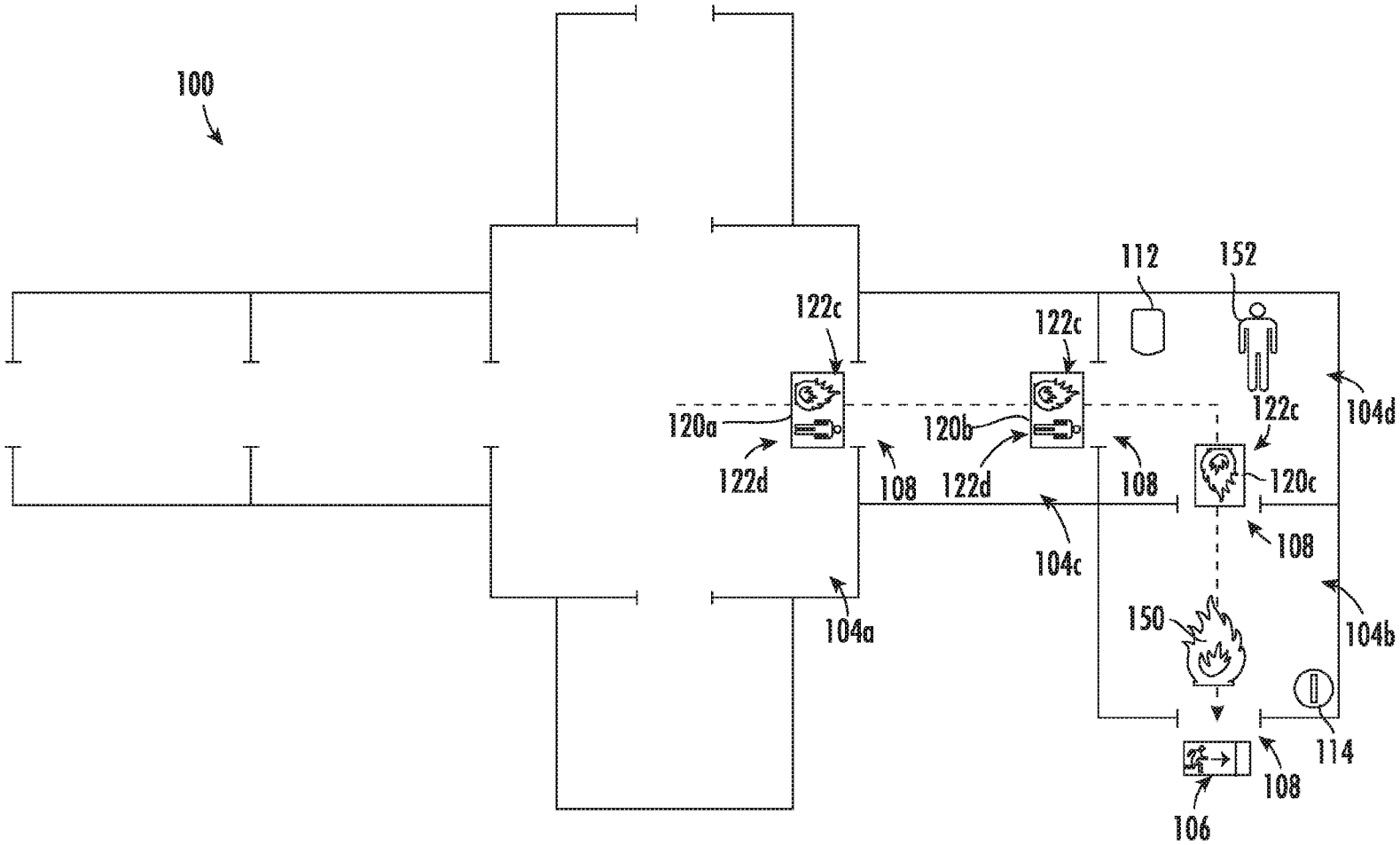

Referring now to FIG. 6, while continuing to reference FIGS. 1-2. FIG. 6 illustrates the operations of the system 100 in a fourth example. In the example of FIG. 6, the plurality of rooms 104 comprise a first room 104*a* and a second room 104*b* connected to the first room 104*a* by at least one entryway 108. There may be rooms 104*c*, 104*d* in between the first room 104*a* and the second room 104*b*. A fire 150 is detected in the second room 104*b* using a fire detector 114 and a human being 152 is detected in a fourth room 104*d* between the first room 104*a* and the second room 104*b* using a human presence detector 112. The plurality of signs 120 comprises a first sign 120*a* in the first room 104*a* located at an entryway 108 towards the second room 104*b*. The plurality of signs 120 may also include a second sign 120*b* in the third room 104*c* located at an entry way 108 towards the fourth room 104*d* and a third sign 120*c* in the fourth room 104*d* located at an entry way 108 towards the second room 104*b*. The signs 120*a*, 120*b*, 120*c* may display a fire symbol 122*c* since a fire 150 has been detected in the second room 104*b*. The first sign 120*a* and second sign 120*b* display a human symbol 122*d* since a person is detected ahead on the path to the second room 104*b*.

Figure 7:
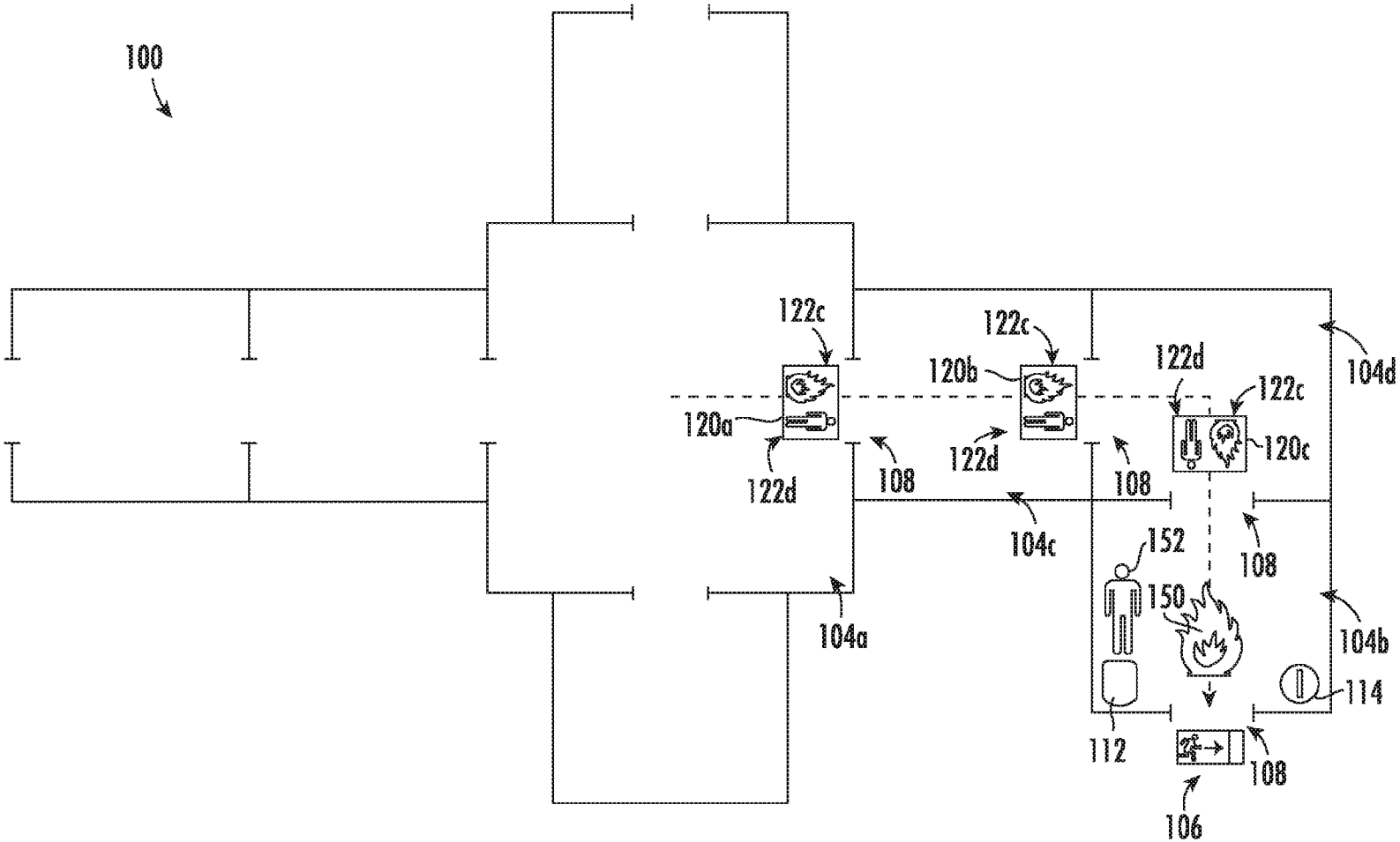

Referring now to FIG. 7, while continuing to reference FIGS. 1-2. FIG. 7 illustrates the operations of the system 100 in a fifth example. In the example of FIG. 7, the plurality of rooms 104 comprise a first room 104*a* and a second room 104*b* connected to the first room 104*a* by at least one entryway 108. There may be rooms 104*c*, 104*d* in between the first room 104*a* and the second room 104*b*. A fire 150 is detected in the second room 104*b* using a fire detector 114 and a human being 152 is detected in the second room 104*b* using a human presence detector 112. The plurality of signs 120 comprises a first sign 120*a* in the first room 104*a* located at an entryway 108 towards the second room 104*b*. The plurality of signs 120 may also include a second sign 120*b* in the third room 104*c* located at an entry way 108 towards the fourth room 104*d* and a third sign 120*c* in the fourth room 104*d* located at an entry way 108 towards the second room 104*b*. The signs 120*a*, 120*b*, 120*c* display evacuation information 122 including a human symbol 122*d* when there is no exit 106 located between the first room 104*a* and the second room 104*b* and also a human located between the first room 104*a* and the second room 104*b*. The signs 120*a*, 120*b*, 120*c* may also display a fire symbol 122*c* since a fire 150 has been detected in the second room 104*b*.

Figure 8:
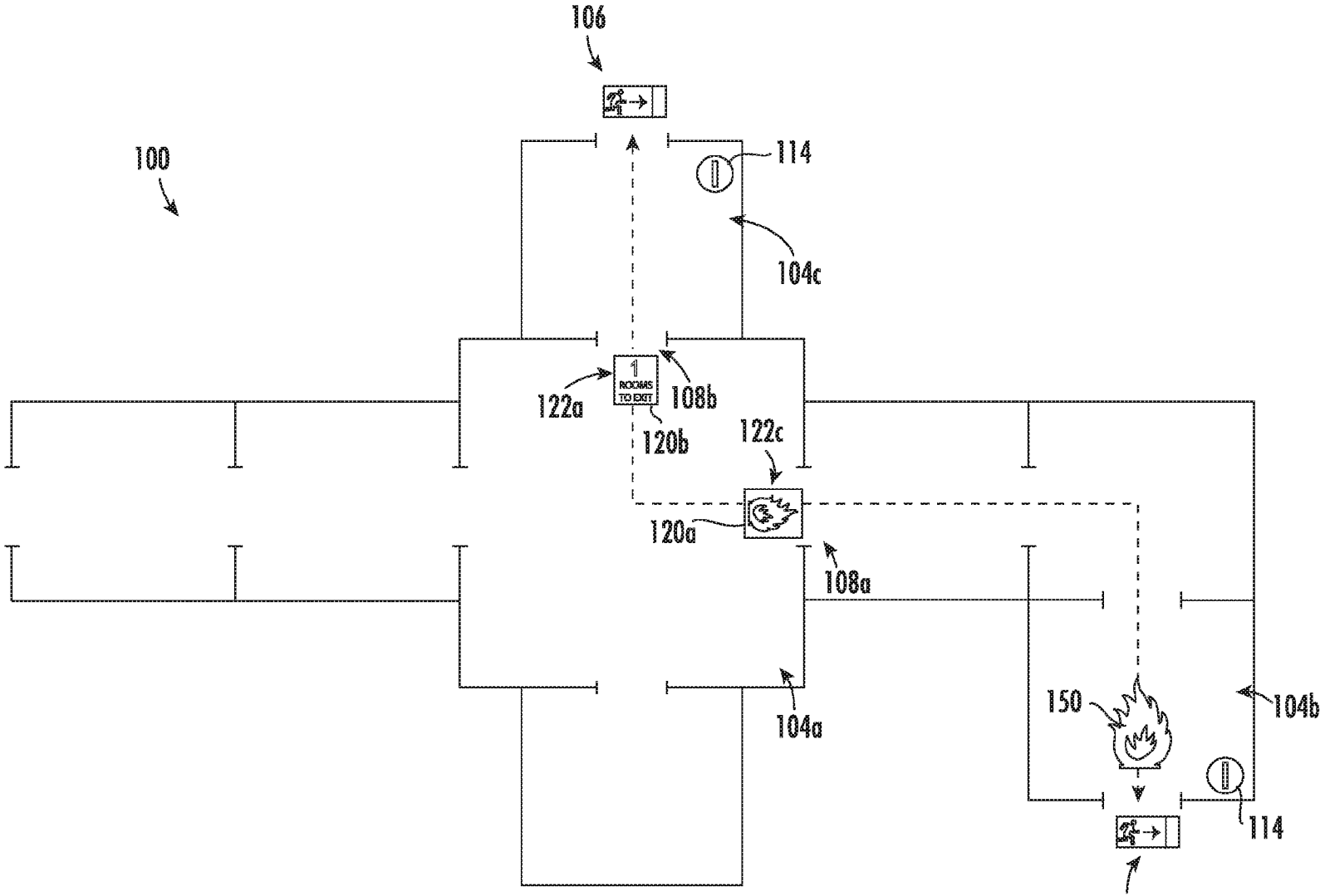

Referring now to FIG. 8, while continuing to reference FIGS. 1-2. FIG. 8 illustrates the operations of the system 100 in a sixth example. In the example of FIG. 8, the plurality of rooms 104 comprise a first room 104*a*, a second room connected to the first room 104*a* by a first entryway 108*a*, and a third room 104*c* connected to the first room 104*a* by a second entryway 108*b*. A fire 150 is detected in the second room 104*b* using a fire detector 114. The plurality of signs 120 comprises a first sign 120*a* in the first room 104*a* located at the first entryway 108*a*. The first sign 120*a* displaying evacuation information 122 including a fire symbol 122*c*. The plurality of signs 120 also comprises a second sign 120*b* in the first room 104*a* at the second entryway 108*b*. The second sign 120*b* displaying evacuation information 122 including a number of rooms 122*a* between the second sign 120*b* and an exit 106 located nearest the second sign 120*b*. The third room 104*c* may also include a fire detector 114 to ensure that the evacuation route to the exit 106 through the third room 104*c* is safe.

Figure 9:
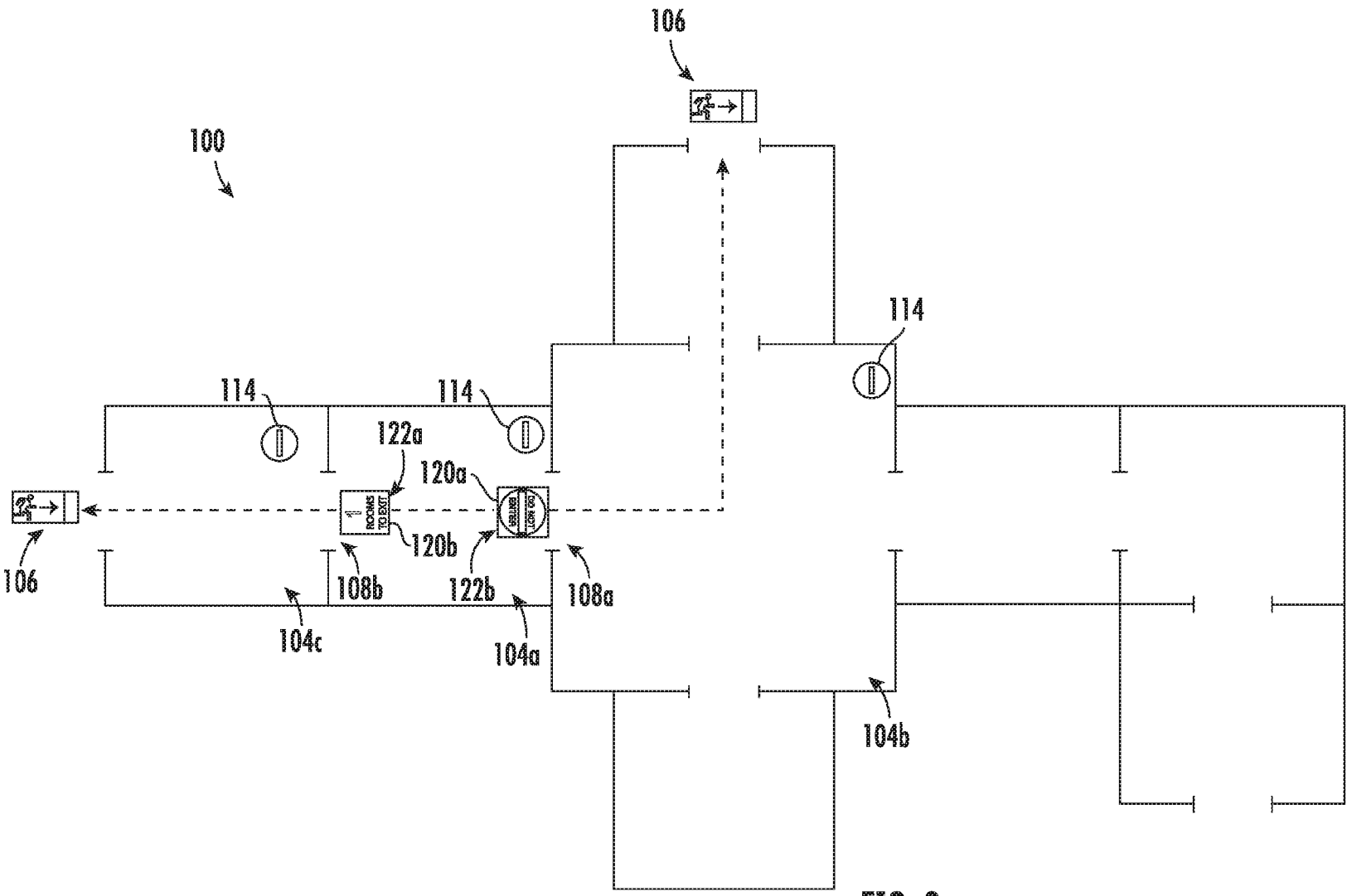

Referring now to FIG. 9, while continuing to reference FIGS. 1-2. FIG. 9 illustrates the operations of the system 100 in a seventh example. In the example of FIG. 9, the plurality of rooms 104 comprise a first room 104*a*, a second room 104*b* connected to the first room 104*a* by first entryway 108*a*, and a third room 104*c* connected to the first room 104*a* by a second entryway 108*b*. The third room 104*c* is closer to an exit 106 than the second room 104*b*. No fire 150 is detected by any fire detector 114 in any of the three rooms 104*a*-104*c*, thus multiple viable evacuation routes to exits 106 exist but one is shorter than the other. The plurality of signs 120 comprises a first sign 120*a* in the first room 104*a* located at the first entryway 108*a*. The first sign 120*a* displaying evacuation information 122 including a do not enter symbol 122*b*. The plurality of signs 120 also comprises a second sign 120*b* in the first room 104 at the second entryway 108*b*. The second sign 120*b* displaying evacuation information 122 including a number of rooms 122*a* between the second sign 120*b* and an exit 106 located nearest the second sign 120*a*.

Figure 10:
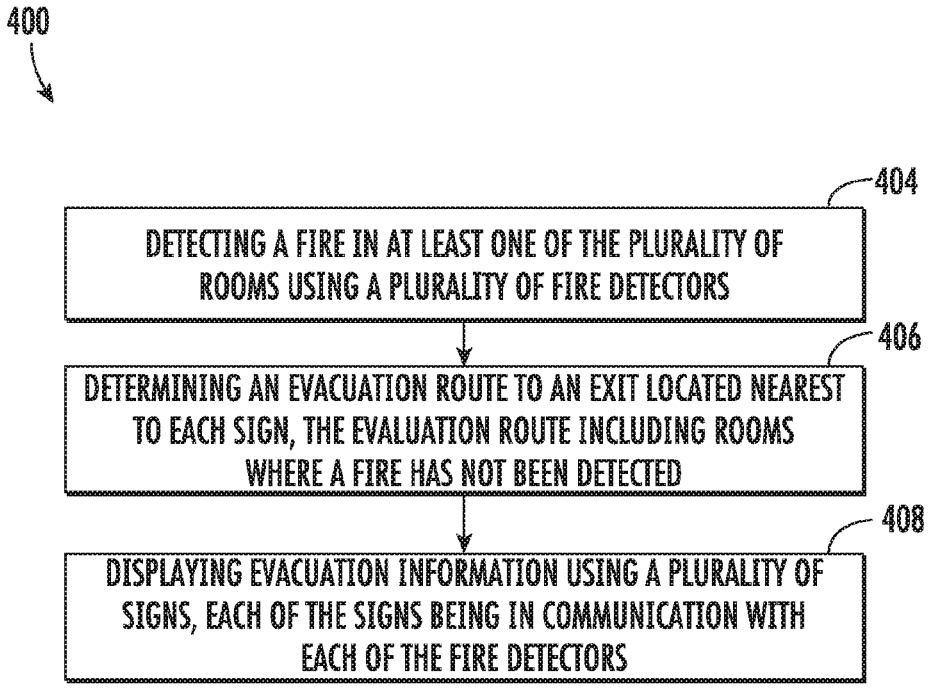
FIG. 10 is a flow diagram illustrating a method of determining fire danger within a building composed of a plurality of building zones, according to an embodiment of the present disclosure.

Turning now to FIG. 10 while continuing to reference FIG. 1-2, FIG. 10 shows a flow diagram illustrating a method 400 of directing an emergency evacuation within a building 102 composed of a plurality of rooms 104 separated by entryways 108 according to an embodiment of the present disclosure. At block 404, a fire 150 is detected in at least one of the plurality of rooms 104 using a plurality of fire detectors 114. At block 406 an evacuation route to an exit 106 located nearest to each sign 120 is determined. The evacuation route includes rooms 104 where a fire 150 has not been detected. At block 408, evacuation information 122 is displayed using a plurality of signs 120. Each of the signs 120 being in communication with each of the fire detectors 114. The evacuation information 122 includes a number of rooms 122*a* along the evacuation route between the sign 120 displaying the evacuation information 122 and the exit 106 located nearest to the sign displaying the evacuation information.

While the above description has described the flow process of FIG. 10 in a particular order, it should be appreciated that unless otherwise specifically required in the attached claims that the ordering of the steps may be varied.

As described above, embodiments can be in the form of processor-implemented processes and devices for practicing those processes, such as a processor. Embodiments can also be in the form of computer program code containing instructions embodied in tangible media, such as floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the exemplary embodiments. When implemented on a general-purpose microprocessor, the computer program code segments configure the microprocessor to create specific logic circuits.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A system for directing an emergency evacuation within a building composed of a plurality of rooms separated by entryways, the system comprising:

a plurality of fire detectors configured to detect a fire in each of the plurality of rooms;

a plurality of signs configured to display evacuation information, each of the plurality of signs being in communication with each of the plurality of fire detectors and configured to determine an evacuation route to an exit located nearest to each sign;

a plurality of human presence detectors configured to detect a human being in each of the plurality of rooms, each of the plurality of human presence detectors being in communication with each of the plurality of sign, wherein the evacuation information includes a human being symbol when the human being is detected in a room along the evacuation route for purposes of assisting in search and rescue.

2. The system of claim 1, wherein:

the evacuation route does not pass through a room where a fire has been detected.

3. The system of claim 2, wherein:

the evacuation information includes a number of rooms between the sign displaying the evacuation information and the exit located nearest to the sign displaying the evacuation information.

4. The system of claim 1, wherein:

each of the plurality of rooms includes a sign at each entryway.

5. The system of claim 1, wherein:

the evacuation information includes a fire symbol when a fire is detected along the evacuation route.

6. The system of claim 1, wherein:

the evacuation information includes a warning if a route is not the shortest evacuation route.

7. The system of claim 1, wherein:

the plurality of rooms comprises a first room and a second room connected to the first room by at least one entryway, the second room having no exit other than an entryway towards the first room; and the plurality of signs comprises a first sign in the first room located at an entryway towards the second room, the first sign displaying evacuation information including a do not enter warning.

8. The system of claim 1, wherein:

the plurality of rooms comprises a first room and a second room connected to the first room by at least one entryway, a fire being detected in the second room; and the plurality of signs comprises a first sign in the first room located at an entryway towards the second room, the first sign displaying evacuation information including a fire symbol.

9. The system of claim 1, wherein:

the plurality of rooms comprises a first room and a second room connected to the first room by at least one entryway, a fire being detected in the second room; and the plurality of signs comprises a first sign in the first room located at an entryway towards the second room, the first sign displaying evacuation information including a fire symbol when there is no exit located between the first room and the second room.

10. The system of claim 1, wherein:

the plurality of rooms comprises a first room and a second room connected to the first room by at least one entryway, a fire being detected in the second room and the human being detected in a third room between the first room and the second room; and the plurality of signs comprises a first sign in the first room located at an entryway towards the second room, the first sign displaying evacuation information including a human symbol when there is no exit located between the first room and the second room.

11. The system of claim 1, wherein:

the plurality of rooms comprises a first room and a second room connected to the first room by at least one entryway, a fire being detected in the second room and the human being detected in the second room; and the plurality of signs comprises a first sign in the first room located at an entryway towards the second room, the first sign displaying evacuation information including a human symbol when there is no exit located between the first room and the second room.

12. The system of claim 1, wherein:

the plurality of rooms comprises a first room, a second room connected to the first room by first entryway, and a third room connected to the first room by a second entryway, a fire being detected in the second room; and the plurality of signs comprises:

a first sign in the first room located at the first entryway, the first sign displaying evacuation information including a fire symbol; and a second sign in the first room at the second entryway, the second sign displaying evacuation information including a number of rooms between the second sign and an exit located nearest the second sign.

13. The system of claim 1, wherein:

the plurality of rooms comprises a first room, a second room connected to the first room by first entryway, and a third room connected to the first room by a second entryway, the third room being closer to an exit than the second room; and the plurality of signs comprises:

a first sign in the first room located at the first entryway, the first sign displaying evacuation information including a do not enter symbol; and a second sign in the first room at the second entryway, the second sign displaying evacuation information including a number of rooms between the second sign and an exit located nearest the second sign.

14. A method of directing an emergency evacuation within a building composed of a plurality of rooms separated by entryways, the method comprising:

detecting a fire in at least one of the plurality of rooms using a plurality of fire detectors;

determining an evacuation route to an exit located nearest to each sign, the evacuation route including rooms where a fire has not been detected;

displaying evacuation information using a plurality of signs, each of the plurality of signs being in communication with each of the plurality of fire detectors, wherein the evacuation information includes a number of rooms along the evacuation route between the sign displaying the evacuation information and the exit located nearest to the sign displaying the evacuation information; and detecting, using a plurality of human presence detectors, a human being, each of the plurality of human presence detectors being in communication with each of the plurality of sign, wherein the evacuation information includes a human being symbol when the human being is detected in a room along the evacuation route for purposes of assisting in search and rescue.

15. A computer program product tangibly embodied on a computer readable medium, the computer program product including instructions that, when executed by a processor, cause the processor to perform operations comprising:

detecting a fire in at least one of a plurality of rooms using a plurality of fire detectors;

determining an evacuation route to an exit located nearest to each sign, the evacuation route including rooms where a fire has not been detected;

displaying evacuation information using a plurality of signs, each of the plurality of signs being in communication with each of the plurality of fire detectors, wherein the evacuation information includes a number of rooms along the evacuation route between the sign displaying the evacuation information and the exit located nearest to the sign displaying the evacuation information; and detecting, using a plurality of human presence detectors, a human being, each of the plurality of human presence detectors being in communication with each of the plurality of sign, wherein the evacuation information includes a human being symbol when the human being is detected in a room along the evacuation route for purposes of assisting in search and rescue.

* * * * *